United States Patent [19]

Albenda

[11] Patent Number: 5,001,862

[45] Date of Patent: Mar. 26, 1991

[54] SAFETY ATTACHMENT FOR HINGED SIDE OF DOORS

[76] Inventor: Abraham Albenda, 45 Falmouth St., Brooklyn, N.Y. 11235

[21] Appl. No.: 440,461

[22] Filed: Nov. 20, 1989

Related U.S. Application Data

[63] Continuation of Ser. No. 134,835, Dec. 18, 1987, abandoned.

[51] Int. Cl.[5] ..... E06B 3/88

[52] U.S. Cl. ..... 49/383; 16/251

[58] Field of Search ..... 16/251, 250, 225; 49/383

[56] References Cited

U.S. PATENT DOCUMENTS

| | | | |
|---|---|---|---|
| 474,633 | 5/1882 | Glazier . | |
| 613,592 | 11/1898 | Nagley . | |
| 1,444,398 | 2/1923 | Shephard | 49/383 X |
| 1,626,844 | 5/1927 | Kuhn | 49/383 X |
| 2,641,792 | 6/1953 | Peeler . | |
| 2,686,942 | 8/1954 | Spector . | |
| 2,694,234 | 11/1954 | Roby et al. . | |
| 3,616,487 | 11/1971 | Dearth | 16/225 |
| 3,827,183 | 8/1974 | Zimmerman . | |
| 4,040,142 | 8/1977 | Ippolito . | |
| 4,261,140 | 9/1981 | McLean . | |
| 4,290,233 | 9/1981 | Hubbard . | |

FOREIGN PATENT DOCUMENTS

| | | | |
|---|---|---|---|
| 528421 | 3/1957 | Belgium | 49/383 |
| 2565622 | 12/1985 | France | 16/250 |
| 8501481 | 12/1986 | Netherlands | 49/383 |
| 14082 | 7/1895 | United Kingdom | 49/383 |
| 24044 | of 1904 | United Kingdom | 49/383 |
| 2019475 | 10/1979 | United Kingdom | 49/383 |

*Primary Examiner*—Richard K. Seidel
*Assistant Examiner*—Carmine Cuda
*Attorney, Agent, or Firm*—Frishauf, Holtz, Goodman & Woodward

[57] ABSTRACT

A finger, hand and other body part protector for hinged doors comprises an aesthetically pleasing foldable protective member which may be accordion-like, in the shape of a recoiling tube, etc., that extends over at least a portion of the height of the front and/or rear face opening or gap on the hinged side of a door. The device automatically expands and contracts to cover gaps created by the opening and closing of the door in a highly unobtrusive manner, thereby providing protection against insertion of body parts or the like into said gaps and resultant injury when the door is closed.

11 Claims, 4 Drawing Sheets

SAFETY ATTACHMENT FOR HINGED SIDE OF DOORS

This application is a continuation of application Ser. No. 07/134,835, filed Dec. 18, 1987, now abandoned.

BACKGROUND OF THE INVENTION

The present invention relates to a safety device for preventing injury to individuals or animals by stopping anything from entering an opening between a hinged door and the door frame, on either the front or rear face of the hinged side of a door.

The fingers and other body parts of countless children, adults and animals have been severely injured by being pressed between a door and its associated frame, due to inadequate safeguards. A prior art attempt to provide such a safe guard against injury is shown in U.S. Pat. No. 474,633. However, the device of this patent comprises a flat sheet of material which extends outwardly far from the door in some operative positions, and which is unattractive and obtrusive. Since only the flat main portion bends, relatively high forces are applied to the anchoring edges, requiring more secure and permanent types of anchoring.

Therefore, an object of this invention is to provide a simple, inexpensive, durable, reliable, unobtrusive and aesthetically pleasing safety or protective device for a door gap that can be added to an existing door and door frame, without damaging the door, the door frame or the adjacent molding.

Another object of the invention is to provide easy installation for the user, and to provide a door gap protective device that does not create high stresses or forces on the anchoring means for securing same in place.

A further object of the invention is to provide an easy-to-make, easy-to-store, easy-to-ship door gap protective device.

SUMMARY OF THE INVENTION

According to the present invention, a protective device for preventing injury by shielding body parts, particularly the fingers, from getting caught in either the front face or rear face gap at the hinged side of a door, comprises a flexible, protective member for continuously covering the gaps formed at the hinged side of a door when the door is opened and closed. One lateral edge of the protective member is fixedly attached to the molding or door frame or wall adjacent to the hinged side of the door. The protective member extends across the gap between the door and door frame or the like, to a point where the second lateral edge of the device is attached to the door. When the door is closed, at least one inwardly directed fold, curve, depression or re-entrant portion of the protective member placed on the front face of the hinged side of the door will be in its compacted or inwardly folded state. As the door is opened, the protective member will unfold or expand and cover the entire gap between the hinged side of the door and the door frame or the like, regardless of the degree of the opening of the door. The gap formed between the door and the door frame or the like is thus covered whether the door is completely or partially opened.

The same protective device can also be used on the rear face of the hinged side of the door. When the device is placed on the rear face of a closed door, the at least one inwardly directed fold, curve or depression or re-entrant portion is in its extended or unfolded state. The device returns to its compacted or folded state as the door is opened.

The protective device can cover the entire height of the door or any portion of the height thereof, and can be placed on either or both of the rear and front faces of the door.

The one or more folds, curves, depressions, re-entrant portions or joints of the protective member of the present invention reduces the pressure or force exerted on the lateral door and frame attachments and allow for a multitude of methods to be used for anchoring or attaching the protective device to the door and door frame or the like. This distribution or relief of pressure also reduces the chances of breakage or detachment from the door and/or door frame or the like. The sizes of the one or more folds, curves, depressions or re-entrant portions can vary from device to device to accommodate different sized doors. The distance between said one or more folds, curves, depressions or re-entrant portions can also vary on the same individual device, allowing for optimum folding or recoiling ability.

As used in the present description and claims, the term "door frame" means any structure to which a door is hinged. In some cases, for example, a door frame per se is not used - i.e., the door is hinged directly to a wall or other support structure. The term "door frame" thus includes any such structure to which a door is hingedly mounted.

As used in the present description and claims, the term "re-entrant" is used to generally designate any of the different inwardly directed portions of the protective members shown in the drawings and all equivalents thereof. Especially in the claims, the term "re-entrant" is so used for convenience and ease of description.

DETAILED DESCRIPTION

Figure 1:
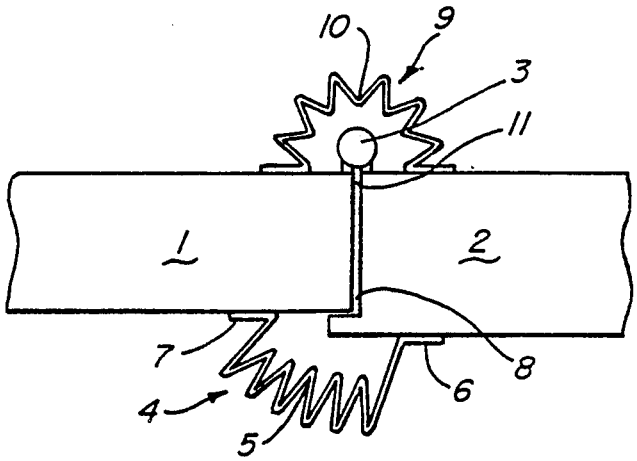
FIG. 1 is a top view of the hinged side of a door showing one embodiment of the present invention attached on both the front and rear faces of a closed door.

FIG. 1 shows a door 1 and the hinge side of the door frame 2 attached together by a hinge 3. A door frame 2 is specifically referred to herein. However, as stated hereinabove, the invention is equally applicable to doors hinged directly to a wall or the like, or other support structure, without using a door frame per se. The term "door frame" is being used generally to refer to any type of support structure to which a door is hingedly connected. Hinge 3 may be any well known type of door hinge. The gap 8 between the door 1 and door frame 2 is covered on the front face of the door 1 by the protective device 4 which is constructed of flexible, material which has a number of accordion-like folds 5 formed therein over at least a substantial portion of the width thereof, and preferably over at least a major portion of the width thereof.

One vertical flange 6 of the protective device 4 is attached to the door frame 2, preferably by an adhesive method so that it can easily be attached and which also causes substantially no damage to the door frame 2. A second vertical flange 7 is preferably adhesively attached to the door 1, so as not to damage the vertical hinged side of the door 1. Screws, nails, or the like could be used to attach the protective devices to the door and/or door frame, such as shown, for example, in U.S. Pat. No. 474,633. A substantially identical protective device 9 is attached to the opposite rear face of the door 1 in the same manner as was the protective device 4 on the front face of the door 1 and the door frame 2. The folds 5 on protective device 4 on the front face of the dcor 1 and frame 2 are in the folded, compressed or compacted state when the door.1 is closed. The folds 10 are in an extended or at least partially unfolded state on the rear face of the door 1 and door frame 2 when the door 1 is closed.

Figure 2:
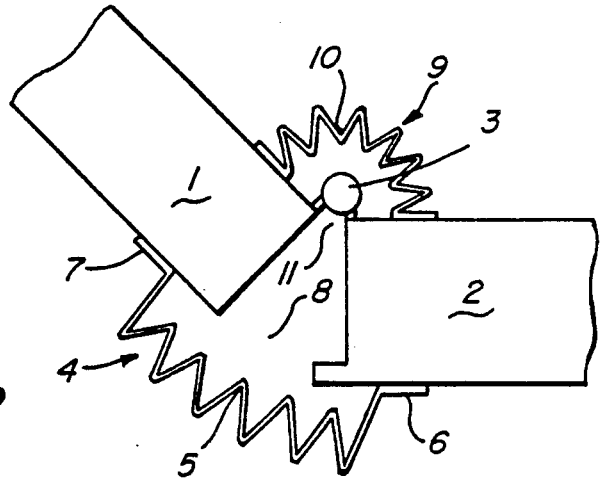
FIG. 2 is a top view of the door arrangement of FIG. 1 showing the door partially opened.

FIG. 2 illustrates the door 1 of FIG. 1 in a partially opened state with gaps 8 and 11 formed between the door 1 and the door frame 2. The protective device 4 on the front face of the door 1 has been extended by partial unfolding of the folds 5. The gap 8 is thus always completely covered over the height of protective device 4. The protective device 9 on the rear face folds or compresses or "pinches" in (i.e. becomes compacted) as the door 1 is partially opened and places the protective device 9 into a partially compressed or compacted state. The gap 11 on the rear face thus is continuously covered by the protective device 9 over the height of the protective device 9.

Figure 3:
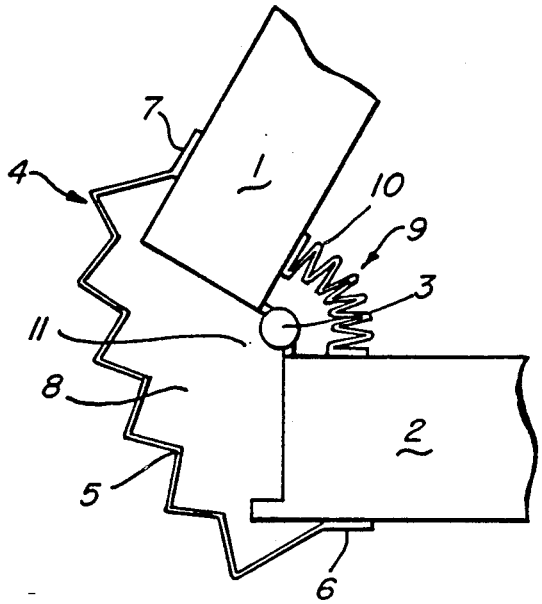
FIG. 3 is a top view of the door arrangement of FIGS. 1 and 2 showing the door completely opened.

FIG. 3 shows the front face of the door 1 of FIGS. 1 and 2 in a fully opened state with the folds 5 of the protective device 4 extended or unfolded to a greater degree, completely covering the larger gap 8. The second protective device 9 on the rear face of the door 1 and door frame 2 is shown in a more compressed state with the folds 10 closely compacted together, completely covering the enlarged gap 11.

Figure 4:
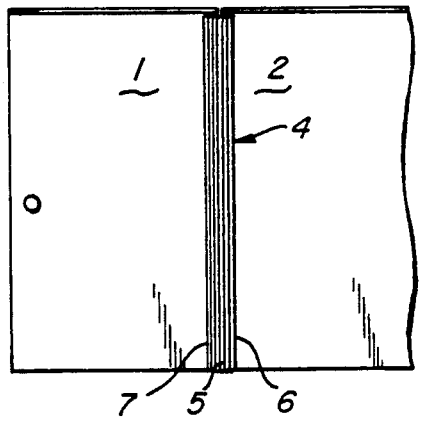
FIG. 4 is a front view of a door showing an embodiment of a protective device of the present invention attached to a closed door.

FIG. 4 depicts the protective device 4 of the present invention covering the gap that exists between the closed door 1 and the door frame 2, and covering the gap which will be formed when the door 1 is opened. The protective device 4 is shown in its compressed state covering the gap along the total height of the door 1.

Figure 5:
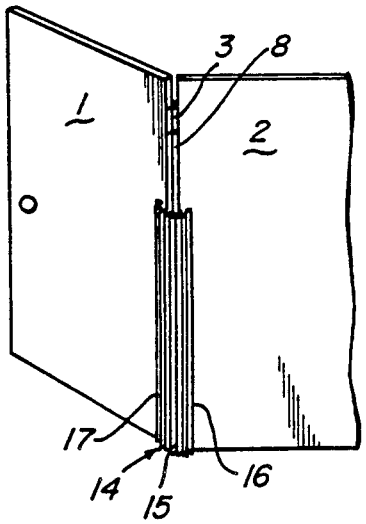
FIG. 5 is a front view of an embodiment of a protective device of the present invention attached to a partially opened door, and with the protective device extending up only partially from the bottom of the door.

FIG. 5 shows a front view of a protective device 14 of the present invention covering the enlarged gap 8 of a partially open door 1. The protective device 14 has its folds 15 in a partially extended or unfolded state and is connected to door 1 and door frame 2 by flanges 17, 16, respectively, preferably by means of adhesive. The protective device 14 is identical to device 4 of FIGS. 1–4, but covers only a portion of the height of the door gap.

Figure 6:
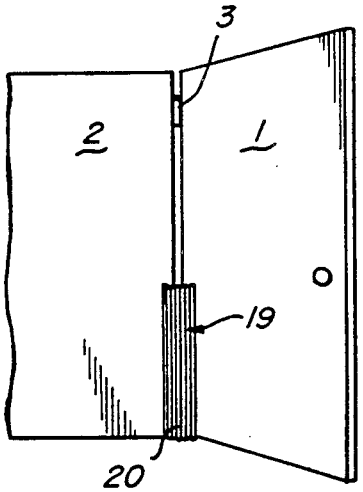
FIG. 6 is a rear view of the partially opened door of FIG. 5.

FIG. 6 is a rear view of the partially open door 1 of FIG. 5, showing a second protective device 19 in a state where the folds 20 thereof are in a slightly coiled or unfolded position. Protective device 19 only covers a portion of the height of the door gap but is otherwise identical to device 9. Protective device 19 could be lengthened to extend over the full height of the door gap.

Figure 7:
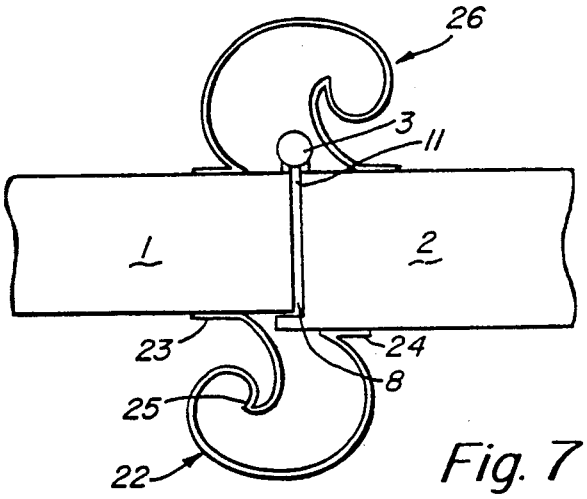
FIG. 7 shows a "recoiling" re-entrant tube-type of protective device according to another embodiment of the present invention, attached to both the inner and outer faces of a closed door.

FIG. 7 shows an alternate embodiment wherein the protective device 22 comprises a recoiling-type tube 22 (actually part of a tube but generally designated herein as a "tube") that functions with one re-entrant (inwardly directed) portion 25, such as a fold or gently curved portion (see FIG. 9) therein. The fold 25 of FIG. 7 or inwardly curved portion (FIG. 9) is retractable as will be clear from the following. The lateral vertical flanges 23 and 24 of recoiling-type tube 22 are attached to the door 1 and door frame 2, respectively, in the same manner as previously described with respect to the protective devices of FIGS. 1–6. The recoiling-type tube 22 with its inwardly directed re-entrant portion continuously covers the gap 8, thereby preventing anything from getting caught in a closing door.

Figure 8:
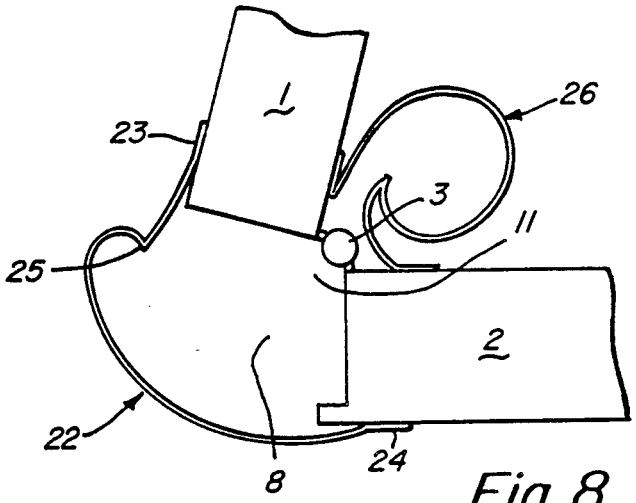
FIG. 8 shows the recoiling re-entrant tube-type device of FIG. 7 with the door opened.

As the door of FIG. 7 opens, the recoiling tube device 22 is extended outward at the single fold or re-entrant portion 25. FIG. 8 shows a partially opened door with the recoiling tube 22 slightly uncoiled and extending completely over the increased gap 8. The size of the fold 25 in the recoiling tube device 22 will be such that the device 22 will cover the gap 8 of a completely opened door. As is shown in FIGS. 7 and 8, a similar recoiling tube device 26 can be placed on the rear face of the door 1 and door frame 2 to cover the rear gap 11. As seen in FIGS. 12–15 more than one fold, curve or re-entrant portion can be formed in one or both of recoiling tube-type devices 22 and 26, as desired.

Figure 9:
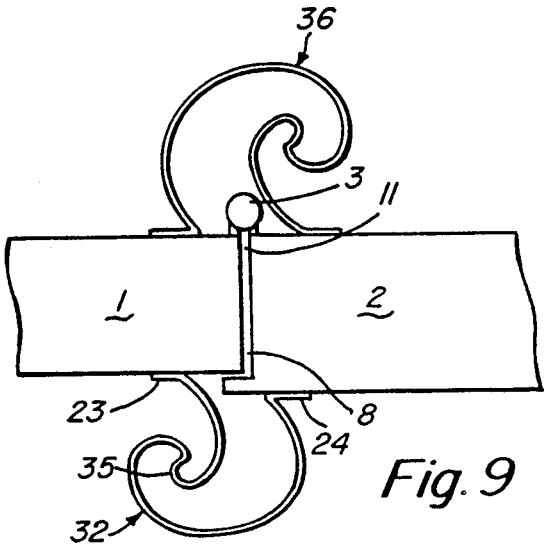
FIG. 9 shows another type of recoiling re-entrant tube-type device according to the present invention which is similar to that of FIGS. 7 and 8.

FIG. 9 shows recoiling tube-type devices 32,36, which are similar to recoiling tube-type devices 22 and 26 of FIGS. 7 and 8, except that the re-entrant fold 25 of FIGS. 7 and 8 is replaced with a curved inwardly directed recoiling portion 35, which is preferably gently curved. In other respects operation of the FIG. 9 embodiment is substantially similar to that of FIGS. 7 and 8.

Figure 10:
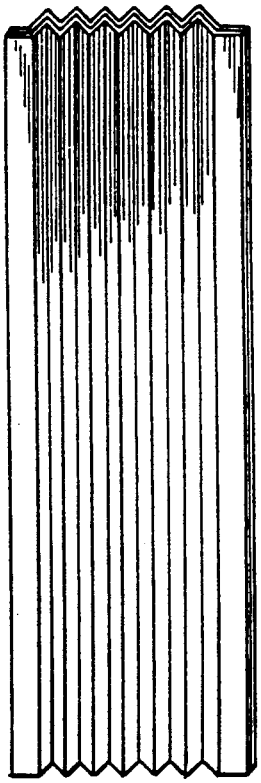
FIG. 10 shows a front perspective view of a pair of accordion-folded-type of protective devices of the present invention, in a substantially folded form, in a condition ready for being packaged for shipping and/or storage, after manufacture.

FIG. 10 illustrates a pair of protective devices of the type shown in FIGS. 1–4, in their compacted state, ready for packaging for shipping and/or storage after manufacture thereof. The devices of FIG. 10 can be more fully compacted, as desired, by pressing the folds closer together. As can be seen from FIG. 10, two of said protective devices (a pair is required for full protection of a given door) can be compactly packaged and shipped, thereby providing a high degree of economy and conservation of space.

Figure 11:
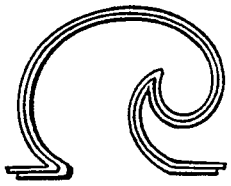
FIG. 11 shows a top view of a pair of nested recoiling-type tubular members of FIGS. 7 and 8 in a compacted or coiled form, ready for packaging for shipping and/or storage after manufacture thereof.

FIG. 11 shows a pair of the recoiling-type protective devices of FIGS. 7 and 8 shown in a compacted condition ready for packaging for shipping and/or storage. They can be compacted further, as desired. This also demonstrates the unique capability of the devices of the present invention to be compactly arranged after manufacture to increase economy of shipping and storage. The protective devices 32, 36 of FIG. 9 would be arranged in their compacted form for shipping and/or storage in a manner similar to that shown in FIG. 11.

While the preferred embodiments of the present invention are described, it is to be understood that these embodiments are given only by way of example, and that they are capable of variation and modification. An example of possible modification would be to have folds 5, 10, 15 and 25 of various different sizes on a single protective device in order to maximize the folding/unfolding, coiling/recoiling (i.e. compaction and extension) of the protective device. Also, the folds or accordian-type portions need not be provided over the complete width of the protective devices of the present invention. They can be provided, if desired, over a central width portion, the outer portions being substantially straight, provided that sufficient folds or re-entrant portions are provided to permit the protective member to be compressed or folded sufficiently that the protective member remains close to the door and door frame, without excessive "blousing".

Figure 12:
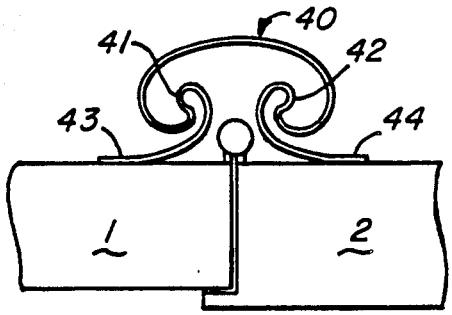
FIGS. 12-15 show top views of modified versions of protective devices according to the present invention.
Figure 13:
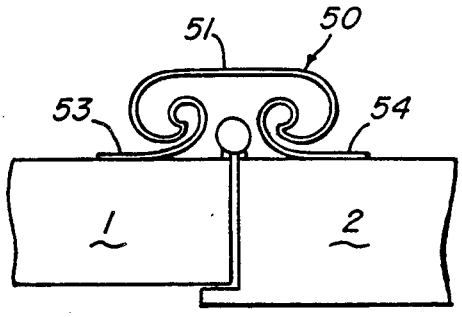
Figure 14:
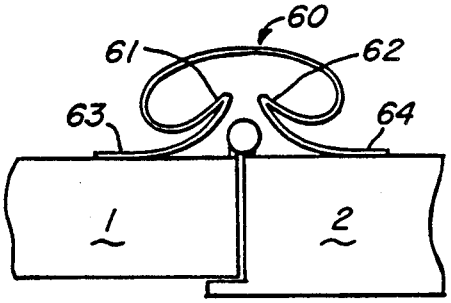
Figure 15:
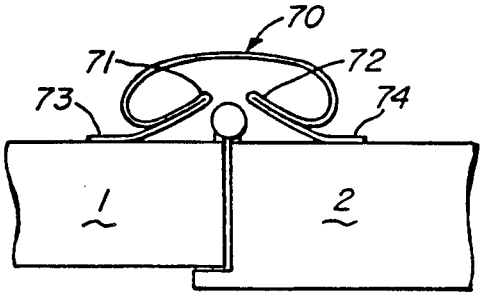

Furhter modifications are illustrated in FIGS. 12–15, which show top views of modified protective members of the present invention. The protective members are shown on only one side of the door in FIGS. 12–15. It should be clear that they may be provided on both sides of the door, as shown in FIGS. 1–8. The protective members of FIGS. 12-are generally mushroom-shaped in top view, as clearly seen in FIGS. 12–15. Also, the protective devices of FIGS. 12–15 may extend either over the complete height of the door, or only over a part of the height of the door, such as shown, for example, in any of FIGS. 4–6. In FIG. 12, the protective member 40 has two bent re-entrant portions (curved) 41 and 42, and is attached to the door and door frame by flanges 43, 44, preferably by means of an adhesive. In FIG. 13, the protective member 50 is similar to that of FIG. 12, but it has a flat outer portion 51. This device is also connected tc the door and door frame by means of flanges 53, 54, preferably by means of an adhesive. The protective member 60 of FIG. 14 has bent re-entrant folds or angled portions 61, 62, and is also connected to the door and door frame by means of an adhesive at flanges 63, 64. The protective member 70 of FIG. 15 is similar to that of FIG. 14, but the bent re-entrant folds or angled portions 71, 72 have longer, substantially straight portions which are folded against each other over a longer distance. This provides a more compact arrangement than the arrangement of FIG. 14.

In any of FIGS. 12–14, the bent re-entrant portions may be curved portions, folds, angled portions, etc., as desired.

The device of the present invention is preferably fabricated of a flexible plastic sheet-like material (preferably semi-rigid), such as polyethylene. Such materials are relatively flexible, but provide sufficient rigidity and "springiness" to be mounted as shown in the drawings and to provide the desired folding/unfolding and/or recoiling effect. Since the materials are relativelY soft and flexible, a body part, even if caught in a fold or re-entrant portion will not be damaged or hurt.

As stated above, the term "re-entrant" is intended to encompass the folds (such as shown in FIGS. 1–6), recoiling members (such as shown in FIGS. 7–9 and 12–15) and any other type of similar or equivalent member having one or more inwardly directed (i.e., re-entrant) and retractable folds or curved or angled portions, to provide the expansion and compression, folding/unfolding, and/or recoiling effect of the present invention, as described hereinabove.

I claim:

1. A one-piece protective device for preventing injury by shielding body parts from both a front and a rear face gap of a hinged side of a door, the door being hingedly coupled to a door frame means at a hinged side of the door, the protective device comprising:

a one-piece flexible protective sheet-like member selectively mountable to a rear side or a front side of said door and to said door frame means to selectively cover either one of siad front and rear face gaps to form a covered gap;

said protective sheet-like member being made entirely of a resilient, flexible and bendable material and extending in the vertical direction of said covered gap so as to cover at least a substantial portion of the height of said gap corresponding to the vertical extent of said protective sheet-like member;

said protective sheet-like member having a generally mushroom shape in top view, and including a pair of vertically extending bent re-entrant portions on opposite side portions of the sheet-like member and a substantially central portion between said bent re-trant portions, each of said bent re-entrant portions being directed inwardly toward the covered gap, each of said bent re-entrant portions and said substantially central portion extending over the complete height of said protective sheet-like member, one of said inwardly bent re-entrant portions being adjacent the door and the other of said inwardly bent re-entrant portions being adjacent said door frame means;

each of said inwardly bent re-entrant portions including a first gently curved inwardly bent section of said protective sheet-like member which is bent inwardly toward the covered gap and a second gently curved outwardly bent section adjacent said first bent section, said first and second bent sections resiliently and continuously unbending outwardly in a spring-like manner when the door is moved relative to said door frame means to widen the covered gap, thereby always covering the covered gap;

said substantially central portion of said protective sheet-like member blocking said gap and serving as a shield over said gap and preventing pushing in of said substantially central portion into said gap;

said protective sheet-like member further having vertically extending lateral edge portions on opposite outer sides thereof, and adjacent each of said bent re-entrant portions;

means for attaching one of said lateral edge portions of said protective sheet-like member to the door near said gap; and means for attaching the other of said lateral edge portion of said protective sheet-like member to said door frame means near said gap, with said covered gap interposed between said lateral edge portions of said protective sheet-like member;

whereby when said door is moved relative to said door frame means so as to increase the width of said covered gap on one side of the door, said bent re-entrant coiled portions of said protective sheet-like member unbend outwardly in a spring-like manner to cause said protective sheet-like member to gradually expand in the width direction of said increased width covered gap such that said substantially central portion is over said gap to thereby shield said gap to prevent entry of body parts into said gap, said bent re-entrant portions gently re-bending inwardly in a spring-like manner for gradually contracting said protective sheet-like member in the width direction of said gap when said door is moved in a direction to decrease the width of said covered gap.

2. The protective device of claim 1 wherein said substantially central portion of said protective sheet-like member is substantially free of bent re-entrant portions.

3. The protective device of claim 1, wherein said attaching means comprises adhesive means for attaching said lateral edge portions of said protective sheet-like member to said door and to said door frame means.

4. The protective device of claim 1, wherein said protective sheet-like member extends vertically for substantially the complete height of said gap.

5. The protective device of claim 1, wherein said protective sheet-like member is semi-rigid.

6. The protective device of claim 1, further comprising a further protective sheet-like member substantially similar to the first-mentioned protective sheet-like member, said respective protective sheet-like members being attached to opposite sides of said door to respectively cover the front and rear face gaps at said hinged side of said door.

7. The protective device claim 1, wherein each of said bent re-entrant portions comprises an inwardly directed portion in said protective sheet-like member between a pair of gently curved coiled portions, said inwardly directed portion extending in the vertical direction of said protective member.

8. The protective device of claim 7, wherein said inwardly directed fold is a single portion.

9. The protective device of claim 8, wherein said protective sheet-like member is substantially coiled in the portions thereof extending from said single fold, to thereby provide a recoiling portion in the vicinity of said re-entrant portion.

10. The protective device of claim 9, wherein said recoiling portion is coiled inwardly toward said gap when said gap is in minimum width, and wherein said recoiling portion expands to uncoil said coiled portions when said gap increases in width from said minimum width.

11. The protective device in claim 9, wherein said attaching means comprises adhesive means for attaching said lateral edge portions of said protective sheet-like member to said door and to said door frame means.

* * * * *